US005181844A

United States Patent [19]

Bishop et al.

[11] Patent Number: 5,181,844

[45] Date of Patent: Jan. 26, 1993

[54] ROTARY VANE PUMP WITH CARBON/CARBON VANES

[75] Inventors: Jerry B. Bishop, Wichita, Kans.; Francis A. Schwind; David B. Sawyer, both of Fort Worth, Tex.

[73] Assignee: Sigma Tek, Inc., Augusta, Kans.

[21] Appl. No.: 745,498

[22] Filed: Aug. 15, 1991

[51] Int. Cl.[5] ..... F01C 21/02

[52] U.S. Cl. ..... 418/152; 418/178; 418/179

[58] Field of Search ..... 418/152, 178, 179

[56] References Cited

U.S. PATENT DOCUMENTS 2,491,100 12/1949 Frei ..... 418/179
3,191,852 6/1965 Kaatz et al. ..... 418/152
4,616,985 10/1986 Hattori et al. ..... 418/179
4,804,317 2/1989 Smart et al. ..... 418/179
4,820,140 3/1989 Bishop ..... 418/179

FOREIGN PATENT DOCUMENTS 61-277888 12/1986 Japan ..... 418/179
62-276291 12/1987 Japan ..... 418/179

*Primary Examiner*—Richard A. Bertsch
*Assistant Examiner*—Charles G. Freay
*Attorney, Agent, or Firm*—Harold E. Meier

[57] ABSTRACT

A rotary sliding vane pump having vanes fabricated from a carbon/carbon based material that provides improved performance by inhibiting vane wear, chipping or fracture. The advantages provided by carbon/-carbon based materials may be further enhanced by impregnating each carbon/carbon sliding vane with a teflon based coating.

4 Claims, 3 Drawing Sheets

ROTARY VANE PUMP WITH CARBON/CARBON VANES

TECHNICAL FIELD

The present invention relates to sliding vane rotary pumps, and in particular to a rotary pump having carbon/carbon sliding vanes that provide for improved long-term use while inhibiting vane wear.

BACKGROUND OF THE INVENTION

Sliding vane rotary pumps have a multitude of mechanical and industrial applications and as such are exposed to a wide range of environmental conditions. In one particular application, sliding vane rotary pumps are utilized in a aircraft where the pumps are exposed to severe atmospheric conditions consisting of widely varying partial pressures of natural film-forming atmospheric constituents such as water vapor and oxygen. During such exposure, parts of the pump experience undue wear that tends to lead to possible pump failure.

Heretofore, the component parts of rotary pumps were manufactured from carbon material as disclosed in U.S. Pat. No. 3,191,852 issued to Kaatz, et al. on Jun. 29, 1965. These carbon parts are fabricated by compressing carbon, graphite and various organic binders under high pressure and temperature. Unfortunately, carbon parts manufactured in this manner exhibit very little tensile strength and tend to fail in an erratic manner. Frictional contact between moveable and stationary parts in pumps operating under extreme atmospheric conditions results in deteriorating wear adversely affecting the operational capabilities of the pump. Furthermore, the fragile nature of carbon parts occasionally results in chipping or fracture of the part during use this requiring repair and/or replacement.

To address the limitations of carbon parts, rotary pump manufacturers have proceeded in two different directions. First, as disclosed in U.S. Pat. No. 4,804,317 issued to Smart, et al. on Feb. 14, 1989, a carbon composite material has been used for the side plates and vanes of the rotary pump. A composite carbon part is fabricated by combining carbon based tensile strength fibers (in a cloth weave) with graphite and an organic binder. Although providing improved performance over the prior carbon parts, similar wear, chipping and fracture problem exist with composite carbon parts. Second, as disclosed in U.S. Pat. No. 4,820,140 issued to Bishop on Apr. 11, 1989, a self-lubricating coating has been applied to the pump parts to inhibit wear between the slidable vanes and pump rotor. The coating is comprised of a mixture of lead and polytetrafluoroethylene deposited on the surface of the part to be coated.

SUMMARY OF THE INVENTION

To address the drawbacks associated with prior art carbon, composite carbon and self-lubricating coated pump parts, the sliding vane rotary pump of the present invention utilizes sliding vanes fabricated from a carbon/carbon material. Carbon/carbon is a non-metallic composite material made from carbon or graphite fibers held in a densified carbon matrix to form a material layer. Siding vanes for rotary pumps are fabricated by laminating a plurality of carbon/carbon material layers together. Pump parts manufactured from carbon/carbon material exhibit dependable and consistent performance over a wide range of temperatures and atmospheric conditions. Furthermore, carbon/carbon vanes may be impregnated with a TEFLON ® based coating to enhance their operational characteristics.

BRIEF DESCRIPTION OF THE DRAWINGS

A more complete understanding of the carbon/carbon rotary pump vanes of the present invention may be had by reference to the following Detailed Description when taken in conjunction with the accompanying Drawings wherein.

DETAILED DESCRIPTION OF THE DRAWINGS

Figure 1:
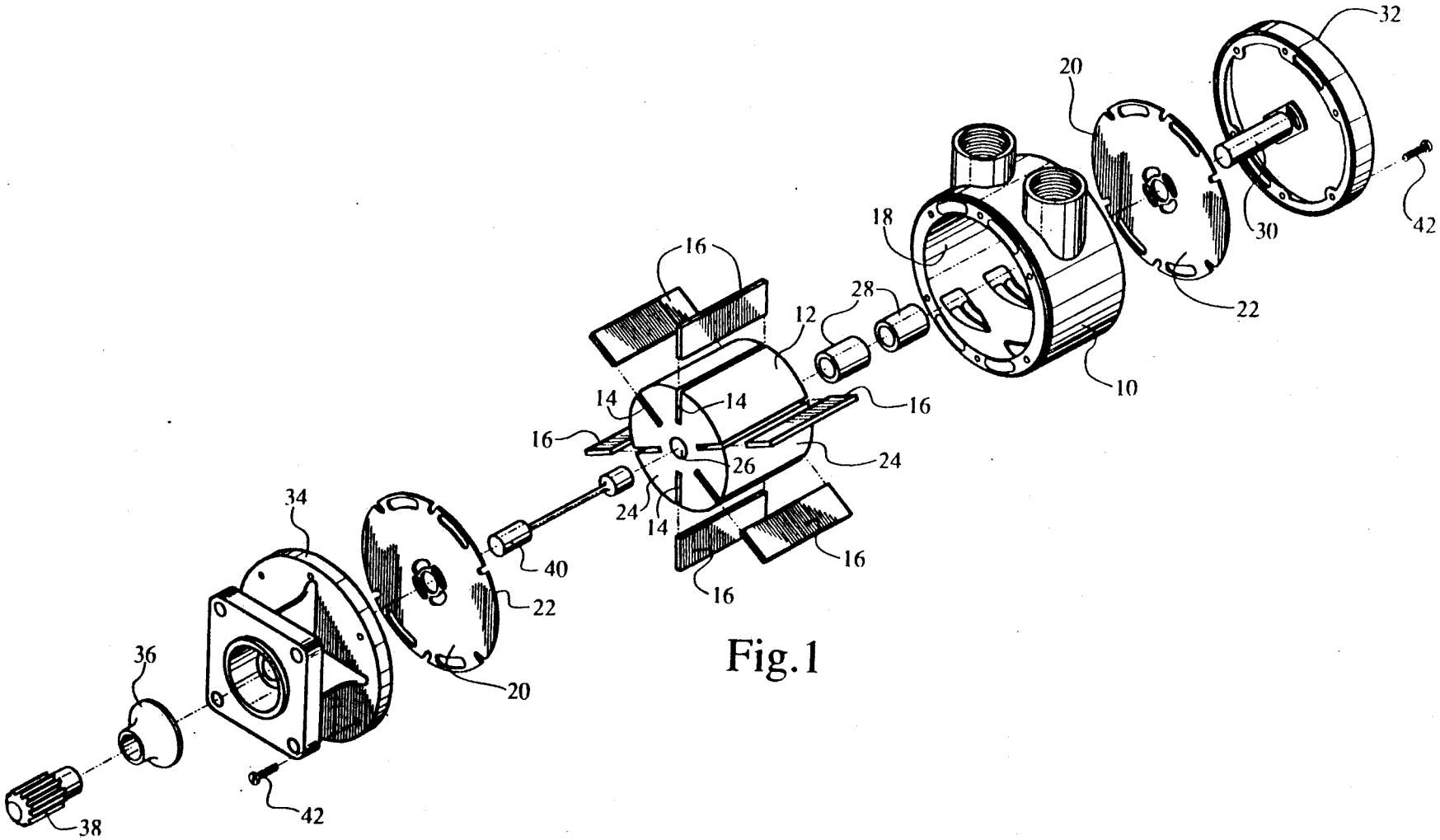
FIG. 1 shows an exploded perspective view of a sliding vane rotary pump utilizing carbon/carbon material vanes.

Referring now to FIG. 1, a metallic liner 10 is shown encasing a rotor 12 for the sliding vane rotary pump shown in exploded perspective view. The rotor 12 further includes a series of radial sliding vane slots 14. A plurality of vanes 16 are disposed in the radial vane slots 14 for slidable movement to engage the interior surface 18 of the liner 10 and pump fluid through the rotary pump. A pair of air transfer end plates 20 are positioned adjacent to the rotor 12 with the interior surfaces 22 of the plates facing the end surfaces 24 of the rotor. The rotor 12 further includes a central bore 26 along the rotor's axis of rotation into which a pair of metallic bushings 28 are centrally located. The interior surface of the bushings 28 are in content with the exterior surface of a shaft 30 that slides into the bushings. A rotor support 32 and mounting flange 34 mount to the liner 10 to enclose the rotor 12 and vanes 16 therein. Within the flange 34 is assembled an oil slinger 36 and drive spline 38, both of which connect to a drive shaft 40 that provides rotary power to the pump. The various parts of the pump are secured together by means of a plurality of taptite screws 42.

Figure 2:
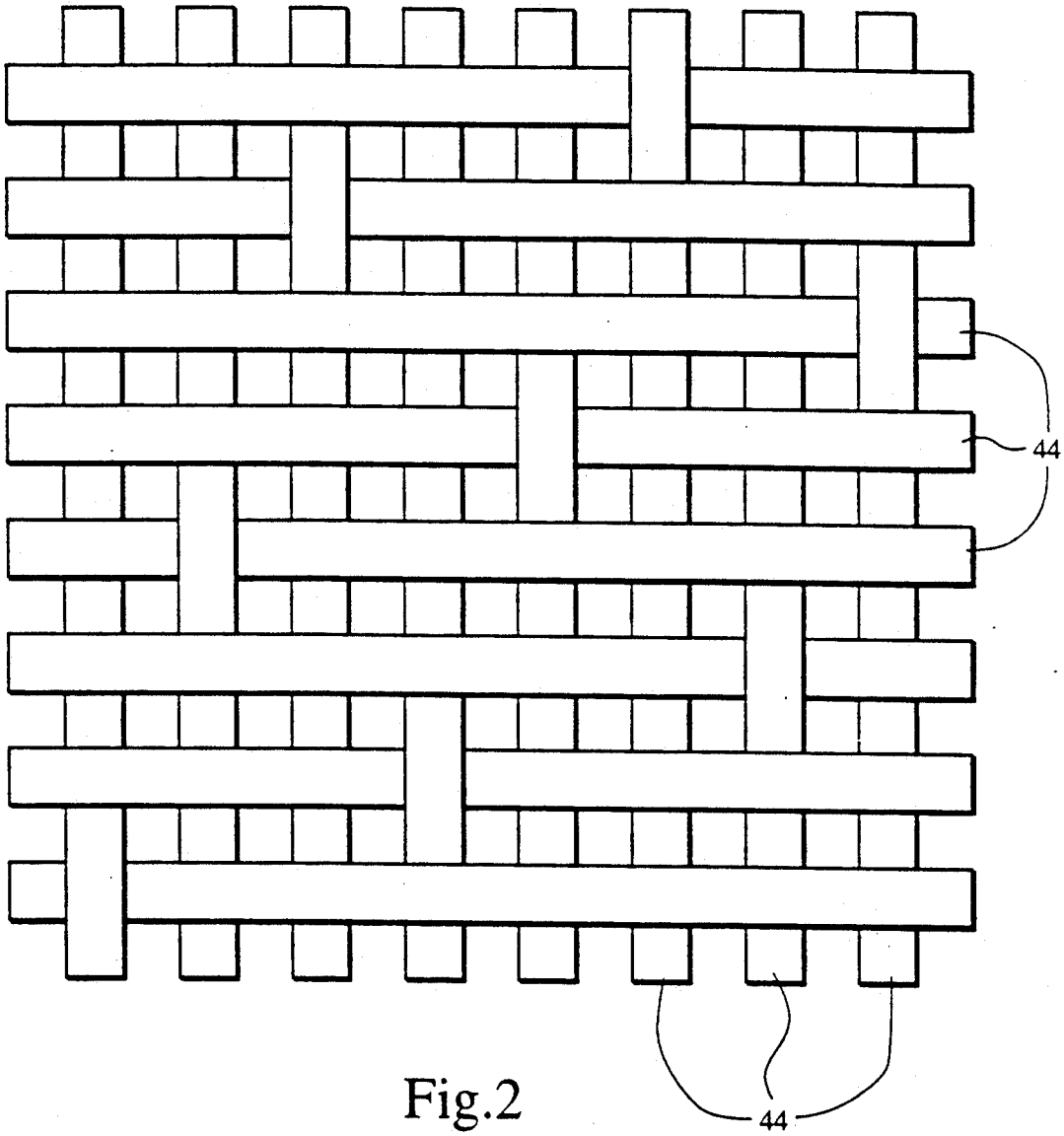
FIG. 2 shows a top schematic view of the preferred eight harness satin weave used to fabricate the carbon fabric.

The vanes 16 for the rotary pump are fabricated from a plurality of laminated layers of carbon/carbon material. Carbon/carbon material is a non-metallic composite material made from carbon or graphite fibers held in a carbon matrix. Numerous fiber types and weave patterns exhibiting a wide range of physical properties and operational characteristics are available to suit specific applications. For use as a sliding vane in a rotary pump, a continuous length, high-strength, high-modulus heat treated carbon fiber 44 in an eight harness satin weave (FIG. 2) is preferred. In the preferred embodiment, a carbon fiber marketed under the trade name "THORNEL" (product identification T-300 3K) from Amoco Performance Products, Inc. was selected for fabrication of the carbon/carbon vanes. "THORNEL" is a registered trademark of Amoco Performance Products, Inc. However, noncontinuous fibers and alternate weave patterns or random fiber layers in the carbon matrix may be used.

Each woven carbon fiber layer is then densified by either a chemical vapor infiltration, chemical vapor deposition or liquid impregnation, with a plurality of densified layers laminated together to fabricate a vane of given dimension. In the preferred embodiment, liquid impregnation using a phenolic resin is used to densify the woven carbon fabric.

As eight harness satin weaving, carbon/carbon material fabrication and lamination processes are well known in the art, further description of such processes herein is deemed unnecessary. It will of course be understood that other fiber types, weave patterns, densifications and fiber heat treatments may be substituted for the densified woven carbon fiber layers.

Figure 3:
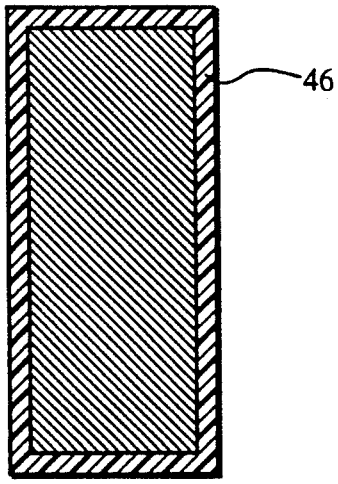
FIG. 3 is a cross-sectional diagram of a sliding vane.

Pump parts manufactured from carbon/carbon material exhibit dependable and consistent performance over a wide range of temperatures and atmospheric conditions. The advantages presented by sliding vanes manufactured from carbon/carbon materials may be further enhanced by impregnating the carbon/carbon vanes with a TEFLON® based coating 46 (see FIG. 3). However, TEFLON® impregnation may not be suitable for some high temperature applications. Coating methods for impregnating TEFLON® in materials manufactured of a carbon/carbon laminate are well known in the art.

Although several embodiments of the carbon/carbon based material sliding vane for rotary pumps have been disclosed in the foregoing Detailed Description and illustrated in the accompanying Drawings, it will be understood that other embodiments and modifications are possible without departing from the scope of the invention.

We claim:

1. An improved sliding vane rotary pump having a metallic liner and a cylindrical rotor, the rotor including a plurality of radial sliding vane slots, comprising:

at least one carbon/carbon sliding vane disposed in a slot to engage said liner for the pumping of a fluid through the rotary pump, the carbon/carbon vane comprising a plurality of layers laminated together from a non-metallic composite material of carbon or carbon graphite fibers held in a densified carbon matrix to form each layer.

2. The improved sliding vane rotary pump as in claim 1 further comprising a TEFLON® based coating impregnating the vane.

3. An improved sliding vane rotary pump having a metallic liner and a cylindrical rotor, the rotor including a plurality of radial sliding vane slots, comprising:

at least one carbon/carbon sliding vane disposed in a slot to engage said liner for the pumping of a fluid through the rotary pump, each vane comprising a plurality of layers laminated together from a non-metallic composite material of carbon or carbon graphite fibers held in a densified carbon matrix and impregnated with a TEFLON® based coating to form each layer.

4. An improved sliding vane rotary pump having a metallic liner and a cylindrical rotor, the rotor including a plurality of radial sliding vane slots therein, comprising:

at least one carbon/carbon sliding vane disposed in a slot to engage said liner for the pumping of a fluid through the rotary pump, each vane comprised of a plurality of laminated layers of woven densified carbon/carbon material of carbon fibers held in a matrix to form each layer, each vane surface having a TEFLON® based coating for inhibiting deterioration of the vane as the vane slides in the slot during the pumping of the fluid.

* * * * *